United States Patent [19]

Cornette

[11] Patent Number: 5,010,964

[45] Date of Patent: Apr. 30, 1991

[54] METHOD AND APPARATUS FOR ORIENTING WELLBORE PERFORATIONS

[75] Inventor: H. Mitchell Cornette, Plano, Tex.

[73] Assignee: Atlantic Richfield Company, Los Angeles, Calif.

[21] Appl. No.: 506,139

[22] Filed: Apr. 6, 1990

[51] Int. Cl.[5] ..... E21B 43/119

[52] U.S. Cl. ..... 175/4.51; 166/297

[58] Field of Search ..... 175/4.51, 4.52, 45; 166/104, 297

[56] References Cited

U.S. PATENT DOCUMENTS

| | | | |
|---|---|---|---|
| 3,426,850 | 2/1969 | McDuffie, Jr. | 175/4.51 X |
| 3,704,749 | 12/1972 | Estes et al. | 166/255 |
| 4,438,810 | 3/1984 | Wilkinson | 166/65.1 |
| 4,523,649 | 6/1985 | Stout | 175/4.51 |
| 4,830,129 | 5/1989 | Stout | 175/4.51 |

*Primary Examiner*—William P. Neuder

*Attorney, Agent, or Firm*—Michael E. Martin

[57] ABSTRACT

A wellbore perforating apparatus for forming casing or wellbore wall perforations in inclined wellbores includes a perforating gun, a reference unit for determining the high side of the wellbore and a motor for rotating the reference unit and perforating gun to orient the perforation charges at a predetermined angle with respect to the high side and the wellbore axis so as to optimize the angle at which the hydraulic fracture is initiated in the formation. The apparatus includes a motor section with extensible grippers for non-rotatably securing the motor section with respect to the wellbore and for rotating the reference unit and the perforating gun.

2 Claims, 1 Drawing Sheet

METHOD AND APPARATUS FOR ORIENTING WELLBORE PERFORATIONS

BECKGROUND OF THE INVENTION

1. Field of the Invention

The present invention pertains to an apparatus for insertion in a wellbore and a method for perforating the wellbore casing at a predetermined angle with respect to the wellbore axis.

2. Background

In the development of oil and gas reservoirs, it has been determined that, particularly with respect to inclined or non-vertical wellbores, the orientation of the wellbore casing perforations or the initiation of fractures is critical to the production of fluids from the formation. A publication entitled "On Fracture Design of Deviated Wells" by C. H. Yew, J. H. Schmidt and Yi Li, (No. SPE 19722, Oct. 1989) published by the Society of Petroleum Engineers, Richardson, Tx., describes certain methodology for determining the orientation of the perforations and fracture initiation for maximum fracture growth and "link-up" with adjacent fractures along the wellbore.

The methodology described in this publication indicates that the orientation of the wellbore axis with respect to the directions of the maximum and minimum in situ principle stresses if an important consideration and that there is a desired position for a line of perforations with respect to the axis for a given formation stress condition. Accordingly, there has been a need to provide a method and aparatus for orienting perforating devices in wellbores at a desired angle which may correspond to the optimum angle determined by the methodology of the above-referenced publication. The present invention is directed to such an improved method and apparatus which is described in further detail herein.

SUMMARY OF THE INVENTION

The present invention provides an improved method for forming perforations in a wellbore at a desired angle or direction with respect to the wellbore axis, particularly for so-called deviated or inclined wellbores. In accordance with an important aspect of the present invention, an improved wellbore perforating apparatus is provided which is lowered into an inclined wellbore, and wherein the apparatus includes means for determining, among other things, the direction of the force of gravity acting on the apparatus as a means of determining a reference point for orienting preforating guns on the apparatus in a predetermined direction with respect to the wellbore axis.

In accordance with another important aspect of the present invention, a unique apparatus is provided for orienting wellbore perforating guns which includes means for determining the orientation of the guns with respect to a reference direction and means for rotationg the perforating guns to develop perforations in the wellbore wall, which may include a casing, which are in a desired direction with respect to the wellbore central axis.

Those skilled in the art will recognize the above-described features of the present invention together with other superior aspects thereof upon reading the detailed description which follows.

DESCRIPTION OF PREFERRED EMBODIMENTS

Figures 1, 2:
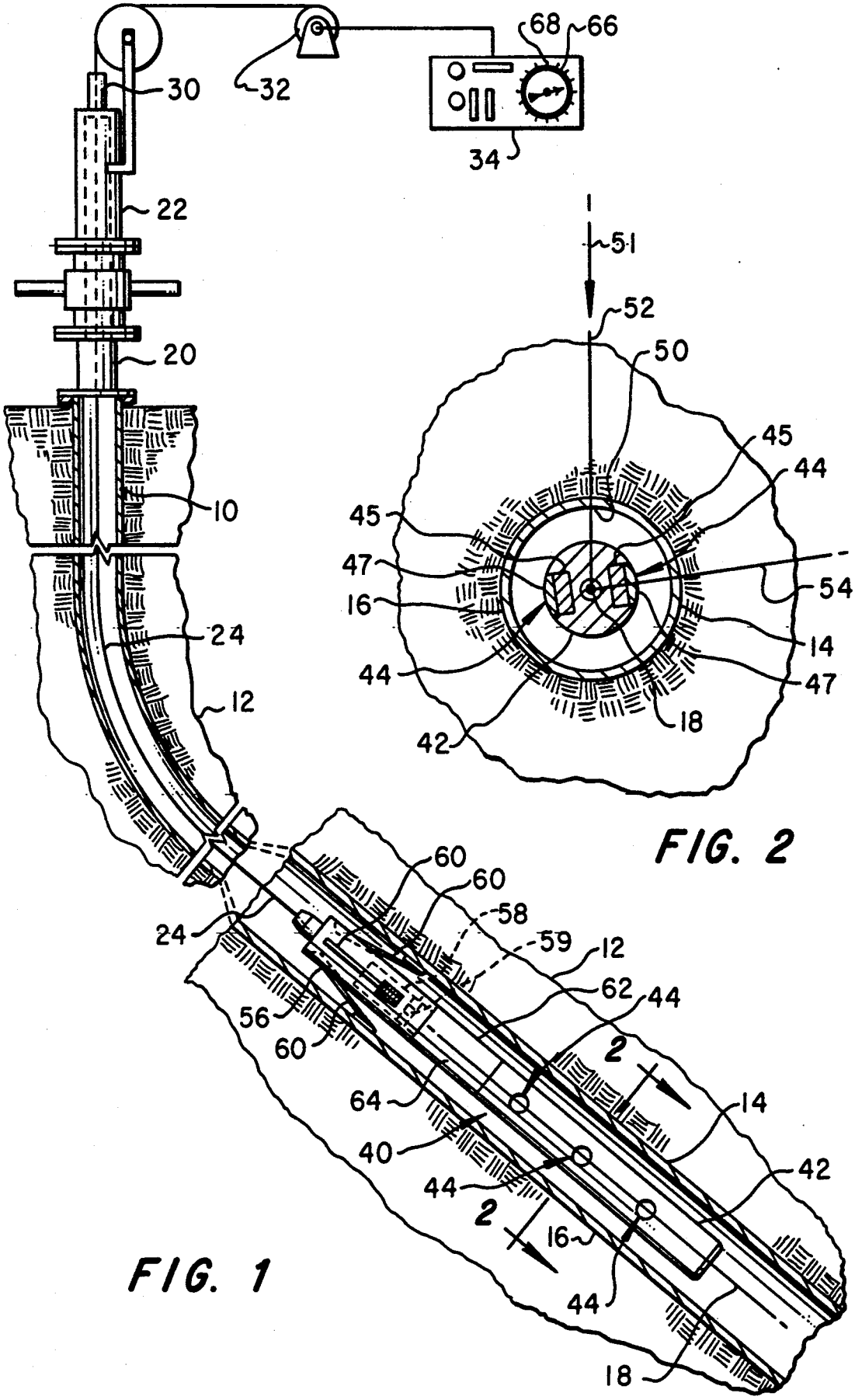
FIG. 1 illustrates in somewhat schematic form an improved wellbore perforating apparatus in accordance with the present invention.
FIG. 2 is a view taken from line 2—2 of FIG. 1.

Referring to FIG. 1, there is illustrated a wellbore 10 which extends into an earth formation 12 and becomes deviated or inclined along a wellbore portion 14 which is provided with a tubular liner or casing 16. The scale of the wellbore portion 14 is expanded for clarity in FIG. 1. The wellbore portion 14 includes a longitudinal central axis 18 which is inclined to the vertical. The wellbore 10 is fitted with a conventional wellhead 20 and a wireline lubricator 22 into and through which an elongated flexible reinforced cable 24 is traversed and extends into the wellbore portions 10 and 14. The cable 24 also extends from the upper end of the lubricator 22 through a suitable stuffing box 30 and is wound on a conventional storage drum 32. The cable 24 is known in the art of oil and gas well drilling and development as a "wireline" and, typically, comprises a multi-electrical conductor assembly having a reinforced jacket or sheath disposed therearound and of suitable strength to act as means for lowering and retrieving certain tools and other devices into wellbores.

The electrical conductors, not shown, of the cable 24 terminate in suitable conductor means, not shown, associated with the drum 32 for transmitting electrical signals by way of conductor means 33 to a control unit 34 for operating a tool or device connected to the cable 24 and for receiving certin information related to conditions in the wellbore as sensed by certain sensors or control devices located in the wellbore and attached to the cable 24. The components associated with the present invention and described hareinabove are conventional in the art of the oil and gas well drilling and development industry and are not believed to require further detailed description to enable one skilled in the art to practice the present invention.

Referring further to FIG. 1, the lower end of the cable 24 is connected to an apparatus, generally designated by the numeral 40, which includes a housing 42 in which a plurality of so-called perforating guns 44 are disposed spaced apart and aimed in predetermined directions, generally radially or transversely with respect to the axis 18. The perforating guns 44 may each comprise an explosive charge 45, see FIG. 2, disposed in the housing 42 and behind a suitable projectile 47 which, when the charge is fired, is propelled radially away from the axis 18 toward the casing 16 whereupon a series of openings or perforations are formed in the casing of predetermined pattern and direction. It is through these openings that formation fracturing and treating fluids are injected into the formation 12 to fracture the formation so that, eventually, formation fluids may backflow through the casing perforations and into the wellbore to be produced therefrom.

As discussed previously in connection with the methodology taught in the Yew et al publication (SPE 19722), the orientation of the perforations to be formed in the casing 16 with respect to the so-called high side of the wellbore portion 14 is critical to enhanced fracture treatment of a formation. Accordingly, it is important to be able to determine the aiming direction of the perforation guns 44 so that the perforations are formed in a particular direction with respect to the axis 18 and the so-called high side of the wellbore portion 14.

This "high side" of the wellbore portion 14 may be defined as lying in a plane which contains the vector 51 of the force of gravity and which plane passes through the wellbore axis 18. If this reference point can be determined, then the perforation guns 44 may be aimed at a particular angle which is subtended by a line which lies in the aforementioned plane and passing through the axis 18 and a second line passing through the axis 18 and defining the azimuth of the direction of the perforation guns. For example, viewing FIG. 2, the inclined portion 14 of the wellbore has a high side indicated by the point 50 through which a line 52 passes and which line also passes through the axis 18 and defines a plane which is parallel to the axis 18 and contains the gravity vector, not shown. Following the teaching of the Yew et al reference it may, for example, be indicated that the direction of perforations to be formed in the casing 16 would be along a line 54 passing through the axis 18 and substanding an angle between the line 54 and the line 52. In at least some instances it is probably desirable to form perforations in both directions along the line 54.

In order to orient the perforating guns 44 to form the perforations as desired, the housing 42 must be oriented, as indicated in FIG. 2, by rotating it about the axis 18 until the perforating guns 44 are properly alligned. The apparatus 40 provides for doing this by including a housing portion 56, FIG. 1, connected to the cable 24 and having disposed therein a rotary electric motor 58. The housing 56 also includes suitable, retractable casing gripper members 60 which are spaced about the circumference of the housing 56 and disposed for radial extension to grip the casing 16 or the portion of the wellbore in which the housing 56 is disposed to prevent rotation of the housing 56 about the axis 18. The gripper members 60 may be suitable arms pivotally mounted on the housing 56 and actuated by suitable extension and retraction means, not shown.

The apparatus 40 also includes a reference unit, generally designated by the numeral 62, disposed in a housing 64 which is connected to the housing 42 and is suitably mounted on the housing 56 for rotation relative thereto about the axis 18. The housing 64 is suitably connected to a rotary output shaft 59 of the motor 58 and adapted to be rotatably driven by the motor about the axis 18 and with respect to the housing 56. Accordingly, in response to operating the motor 58, the reference unit 62 and the housing 42 may be rotated about the axis 18 to a desired directional attitude of the perforating guns 44.

The reference unit 62 may include inertial reference type devices including an accelerometer triad and a gyroscope triad, not shown, for determining the true position in space and orientation of the housing 64 with respect to a reference, which may be the direction of the force of gravity. The reference unit 62 may, for example, be similar to that described in U.S. Pat. No. 4,454,756 to H. E. Sharp, et al, although such a complex unit may not be required to practice the present invention. In fact, the reference unit 62 may include a less complex clinometer arrangement commonly used in determining the directional attitude of inclined wellbores. In all events, the reference unit 62 is adapted to provide signals to the control unit 34 to indicate the angular orientation of the reference unit 62 and the housing 42 with respect to the axis 18 when viewed in a plane normal to the axis as indicated by FIG. 2. The control unit 34 may, as indicated in FIG. 1, include an indicator 66 which indicates the direction of the perforating guns 44 with respect to a reference point 68 which corresponds to the high side point 50 of the wellbore portion 14. The control unit 34 also preferably includes suitable controls for operating the motor 58 to rotate the reference unit 62 and housing 42 to the desired direction of aiming of the perforating guns 44 such as along the line 54 indicated in FIG. 2. The angle betweens the lines 52 and 54 in FIG. 2 would, of course, correspond to the angle Θ specified in the Yew, et al reference.

Thanks to the provision of the perforating apparatus 40, wellbore perforations may be oriented in a specific direction with respect to the directions of the principal stresses in an earth formation so that more effective, continuous formation fractures may be developed. The perforating aparatus 40 may be lowered into the wellbore portion 14 in a conventional manner at the end of the cable 24 utilizing the wireline lubricator 22 and with the gripper arms 60 in a retracted position. Once the perforating apparatus 40 is dispoded in the area of the formation zone to be fractured, the gripper arms 60 are extended to engage the wellbore wall to prevent rotation of the housing 56. The control unit 34 is then operated to read the direction of orientation of the perforating guns 44 and the motor 58 is operated to rotate the reference unit 62 and the housing 42 until the direction of the guns 44 is in the desired position as indicated by the indicator 66. The guns 44 are then fired at will to form the perforations in the casing 16 in the desired position for fracturing the formation in accordance with the method described in the Yew, et al reference. Depending on the construction of the perforating apparatus 40, after firing an initial set of perforation charges 45, the motor 58 may be actuated to rotate the housing 42 and the reference unit 62 to a new selected position either before or after retraction of the gripper arms 60 and movement of the apparatus 40 to a new position in the wellbore.

The apparatus 40 may be constructed using conventional materials and components for wellbore perforating apparatus and wellbore survey apparatus. Thanks to the provision of the reference unit 62 and the motor 58, an accurate placement of perforations in a wellbore wall or casing may be obtained to coincide with the selected position as determined by the methodology of the Yew, et al reference, for example. Although a preferred embodiment of a method and apparatus in accordance with the present invention has been described herein, those skilled in the art will recognize that various substitutions and modefications may be made without departing from the scope and spirit of the invention as recited in the appended claims.

What is claimed is:

1. A method for perforating a casing in a portion of a wellbore inclined to the vertical preparatory to extending a hydraulic fracture into a formation region of interest in a preferred direction of said fracture comprising the steps of:

determining a preferred angular orientation of perforations in said casing for forming said fracture with respect to a reference point on said wellbore and the longitudinal wellbore axis in said region of interest;

providing a perforating apparatus including at least one perforating gun for firing a perforating charge to penetrate said casing to provide an opening for the flow of fluids between said formation and said wellbore, said apparatus including a reference unit for indicating the position of said apparatus in said wellbore with respect to the wellbore axis and said reference point, a housing, gripper means for engagement with said wellbore wall to hold said housing non-rotatable with respect to said axis, and motor means disposed in said housing and operably connected to said reference unit and said perforating gun for ratating said reference unit and said perforating gun to orient said perforating gun in a predetermined direction;

inserting said apparatus into said wellbore and positioning said apparatus adjacent to said region of interest;

determining the high side of said portion of said wellbore defined by a poing on said wellbore wall intersected by a line which lies in a plane which includes the vector indicating the direction of the force of gravity and passing through said wellbore axis;

operating said motor means to orient said perforating gun in said predetermined direction with respect to said line; and operating said apparatus to effect firing of said perforating gun to form at least one perforation in said casing.

2. An apparatus for forming perforations in a wellbore casing extending in an earth formation along a longitudinal wellbore axis inclined to the vertical, said apparatus being adapted to be conveyed into and out of said wellbore and placed in said wellbore adjacent to a region of interest in an earth formation penetrated by said wellbore, said apparatus comprising:

perforating gun means for firing perforating charges to perforate said casing at a predetermined point and in a predetermined direction with respect to a reference point on said wellbore intersected by a line which lies in a plane which includes the vector indicating the direction of the force of gravity and passing through said wellbore axis;

a reference unit adapted to determine the angular orientation of said apparatus in said wellbore with respect to said reference point and said axis;

means for orienting said perforating gun means in said predetermined direction as determined by said reference unit comprising motor means disposed on said apparatus and adapted to rotate said reference unit and said perforating gun means about an axis generally coincident with said wellbore axis; and means for engaging a portion of said wellbore for non-rotatably securing a portion of said apparatus with respect to said wellbore to provide for rotation of said perforating gun means by said motor means.

* * * * *